US008957786B2

(12) United States Patent
Stempnik et al.

(10) Patent No.: US 8,957,786 B2
(45) Date of Patent: Feb. 17, 2015

(54) ENHANCED ALIGNMENT METHOD FOR PARK ASSIST

(71) Applicant: Ford Global Technologies, LLC, Dearborn, MI (US)

(72) Inventors: Vern Stempnik, Roseville, MI (US); Brian Choi, Ann Arbor, MI (US); Mark Crawford, Belleville, MI (US); Aric David Shaffer, Saline, MI (US); Michael David Kane, Brighton, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 42 days.

(21) Appl. No.: 13/898,583

(22) Filed: May 21, 2013

(65) Prior Publication Data

US 2014/0347195 A1 Nov. 27, 2014

(51) Int. Cl.
*G08B 21/00* (2006.01)
*G08G 1/14* (2006.01)

(52) U.S. Cl.
CPC ..... *G08G 1/14* (2013.01)
USPC ..... 340/932.2; 701/41; 180/167

(58) Field of Classification Search
CPC ..... B62D 15/028; B62D 15/0285
USPC ..... 340/425.5, 435, 436, 932.2; 701/1, 41; 348/148; 180/167, 199
See application file for complete search history.

(56) References Cited

U.S. PATENT DOCUMENTS

| | | | |
|---|---|---|---|
| 8,269,616 | B2 | 9/2012 | Uehara |
| 8,319,663 | B2 | 11/2012 | Von Reyher et al. |
| 2005/0285758 | A1 | 12/2005 | Matsukawa et al. |
| 2011/0260887 | A1 | 10/2011 | Toledo et al. |
| 2012/0293664 | A1 | 11/2012 | Hofman et al. |

FOREIGN PATENT DOCUMENTS

| | | | |
|---|---|---|---|
| EP | 1493632 | A1 | 1/2005 |
| EP | 1695114 | A1 | 8/2006 |
| EP | 2119602 | A1 | 11/2009 |
| EP | 2148220 | A1 | 1/2010 |
| EP | 2377728 | A2 | 10/2011 |
| JP | H0628598 | A | 2/2004 |
| WO | WO-03055734 | A1 | 7/2003 |
| WO | WO-2005047931 | A1 | 5/2005 |

*Primary Examiner* — Jeffery Hofsass
(74) *Attorney, Agent, or Firm* — Frank A. MacKenzie; Brooks Kushman P.C.

(57) ABSTRACT

A method of parking a running vehicle includes measuring a length of a parked vehicle that is proximate to a desired parking location, and estimating the width of the parked vehicle based on a regression equation. The running vehicle is parked based on the estimated width.

20 Claims, 6 Drawing Sheets

ENHANCED ALIGNMENT METHOD FOR PARK ASSIST

BACKGROUND

Active park assist systems often rely on ultrasonic sensor technology to scan and locate a suitable parking space to assist drivers in parking their vehicles next to a curb and, when a curb is not recognized, a secondary alignment procedure may be utilized. In this case the park assist algorithm aligns the outside edge of the host vehicle with the outside edge(s) of the one or two vehicles between which the host vehicle will be parked.

SUMMARY

An active park assist system relies on ultrasonic sensor technology to scan and locate a suitable parking space to assist drivers in parking their vehicles next to a curb. However, due to environmental or other conditions, the ultrasonic sensor may have limited capabilities and be limited in effectiveness in detecting and consistently parking the host vehicle parallel to a curb. Thus, the disclosed method is for an automatic parking assist algorithm that avoids parking too deep in a parallel parking spot, to avoid running into a curb, and aligns to an inner edge of a parked vehicle. This avoids contact with an unidentified curb or parking too far away from the curb.

A method of parking a running vehicle includes measuring a first length of a parked vehicle that is proximate to a desired parking location, estimating a second length of the parked vehicle based on the measured first length, and parking the running vehicle based on the estimated second length. The running vehicle is parked by aligning with an inner edge of the parked vehicle.

A non-transitory computer-readable medium tangibly embodying computer-executable instructions includes steps to measure a first length of a parked vehicle that is adjacent to a desired parking location, determine a second length of the parked vehicle based on the measurement, and execute a vehicle parking algorithm based on the second length estimation.

A host vehicle includes a system for measuring a first length of a parked vehicle, and a computer programmed to estimate a second length of the parked vehicle based on the first length, and instruct a controller to park the host vehicle based on the estimated length.

DETAILED DESCRIPTION

Figure 1:
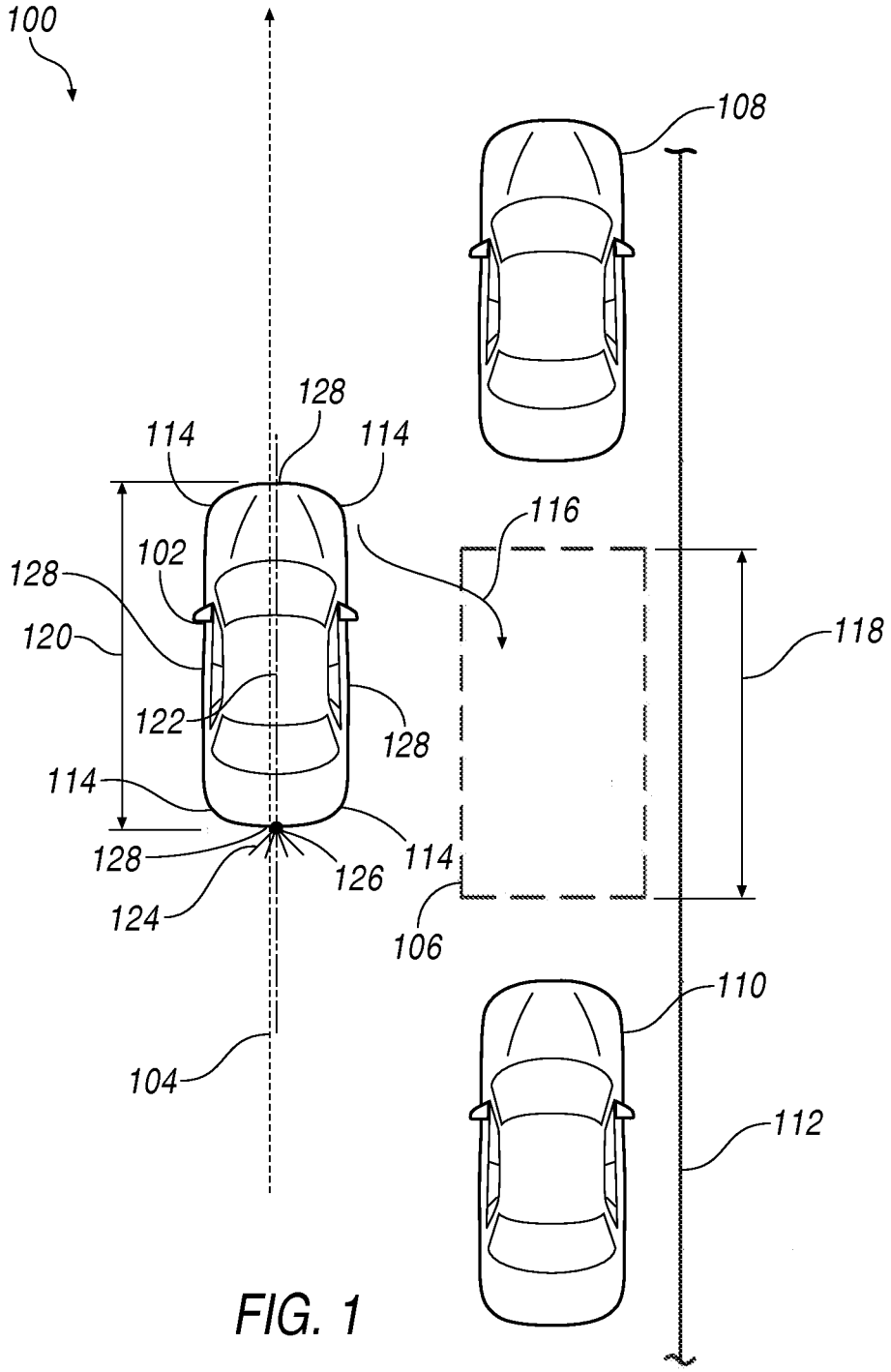
FIG. 1 illustrates a plan view of a host vehicle proximate front and rear cars that define a parking space for parking assist.

FIG. 1 shows a parking assist scenario 100 in which a running or host vehicle 102, such as a car, may employ a park assist system for assisting or instructing a driver in what actions to take to park the vehicle, such as when parallel parking. As host vehicle 102 passes along a path 104, a parking space 106 is identified by the park assist system as located between two parked vehicles 108 and 110. Parking space is thus defined between vehicles 108, 110, and is also defined by a constraint on the far side, such as a curb 112. Parking space 106 may be defined or bounded by any type or number or objects or constraints, not necessarily vehicles 108, 110 and curb 112.

Figure 2:
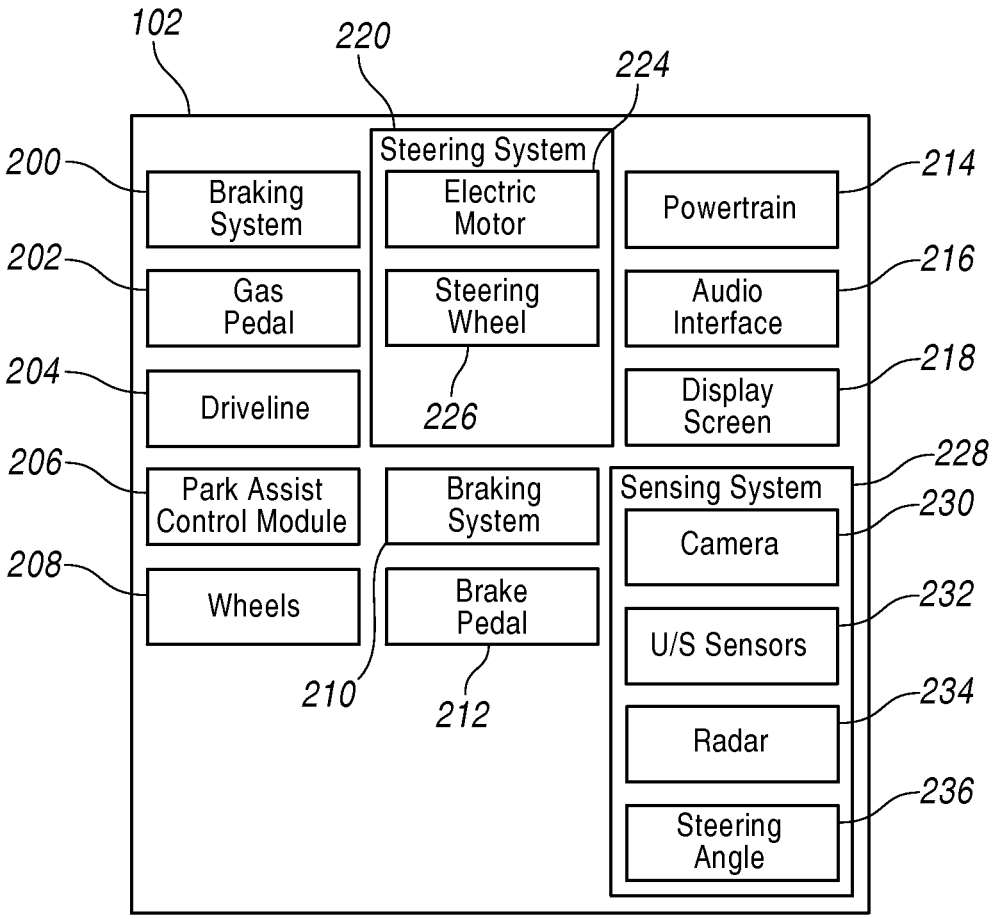
FIG. 2 illustrates elements of a host vehicle for parking assist.

Referring to FIG. 2, host vehicle 102 includes a braking system 200, a gas pedal 202, a driveline 204, a park assist control module (PACM) 206, and wheels 208. Vehicle 102 also includes a braking system 210, a brake pedal 212, a powertrain 214, an audio interface 216, and a display screen 218. A steering system 220 is shown in an example to include an electric motor 224 and a steering wheel 226. Steering system may be used in a power assisted steering system, or steering system 220 may include any type of steering system such as a conventional vacuum/hydraulic system, an electro-hydraulic power assisted system (EHPAS), or a 'steer-by-wire' system. Host vehicle 102 may include an accelerometer that measures an acceleration of vehicle 102.

In the illustrated embodiment, a sensing system 228 is operatively connected to vehicle 102 and may be coupled to PACM 206 to provide input signal(s) thereto. Sensing system 228 includes sensors for sensing the vehicle environment, such as a camera 230, ultrasonic (U/S) sensors 232 (which may include a transmitter and sensor), radar 234, and a steering sensor 236, as examples. Although not illustrated, sensing system 228 may also include systems that include but are not limited to LIDAR, thermal sensors, and GPS. As shown in FIG. 1, four sensors 114, such as ultrasonic sensors, may be located on the left and right sides of vehicle 102 adjacent front and rear bumpers to provide full or near-full 360° coverage around vehicle 102. The number, type, and/or the location of the sensors may be other than illustrated if so desired.

Sensing system 228 may include sensors for detecting the status or mode of operation of various systems on-board the vehicle 102, such as an odometer sensor (not shown) and/or steering wheel angle sensor 236. The odometer sensors may be located on one or more of wheels 226 of vehicle 102 and/or in the driveline system 204 of vehicle 102. Steering wheel angle sensor 236 is associated with steering system 220 of vehicle 102 and may, for example, be located on steering wheel 226 or on a steering column, as an example. Vehicle 102 may also be equipped with video display screen 218 for the display of various types of information to the driver. Vehicle 102 may also include audio interface device 216 such as a speaker, chime, buzzer, or other device for generating sound.

As shown in FIG. 1, vehicle 102 is parked into parking space 106 using PACM 206. To accomplish this, at least one of sensors 114 is used to detect neighboring objects and their location relative to the position of the vehicle 102 as vehicle 102 travels along path 104 and passes objects 110, 108. In FIG. 1, the neighboring objects that define parking space 106 are shown as being the two parked vehicles 110, 108 and curb 112. It is contemplated that PACM 206 may successfully identify a parking space 106 relative to only one object or vehicle, such as either the vehicle 108 or vehicle 110, if present.

PACM 206 includes a data processing component that processes the information from the sensor(s) to evaluate whether vehicle 102 may be successfully parked in parking space 106. The data processing component may, for example, be a micro-computer based device, as is well known. Evaluation by PACM 206 may involve determining if a valid steering trajectory 116 can be performed to park vehicle 102 in parking space 106. If a valid steering trajectory 116 exists, PACM 206 deems parking space 106 to be a feasible parking space. The calculations performed by PACM 206 may include a determination of a proper slot length 118 depending upon considerations such as a length 120 of vehicle 102, and/or an achievable turning radius of vehicle 102, and/or any other geometric considerations related to vehicle 102 and/or other objects in the vicinity of parking space 106.

Movement of vehicle 102 along steering trajectory 116 may be performed in one or more parking maneuvers as may be necessary until it is properly parked. As used herein, one parking maneuver is defined as (1) moving the vehicle rearwardly from a stop into the parking space, (2) stopping the vehicle briefly within the parking space, (3) moving the vehicle forward within the parking space, and (4) then stopping and thus parking the vehicle. At least one actuation or movement of steering system 220 is usually required in association with each of the steps in the parking maneuver to achieve trajectory 116. A subsequent rearward and/or forward movement of vehicle 102, as may be necessary if parking space 106 is too short relative to vehicle length 120 and/or turning radius, defines an additional parking maneuver.

Once it is determined that vehicle 102 is properly parked in a desired parked condition, PACM 206 operates steering system 220 to return it to a centered condition. In one example, this involves actuating electric motor 224 to move steering wheel 226 and associated components of steering system 220 so that the steerable road wheels of vehicle 102 are aligned parallel with a longitudinal (front-to-rear) axis 122 of vehicle 102.

Figure 3:
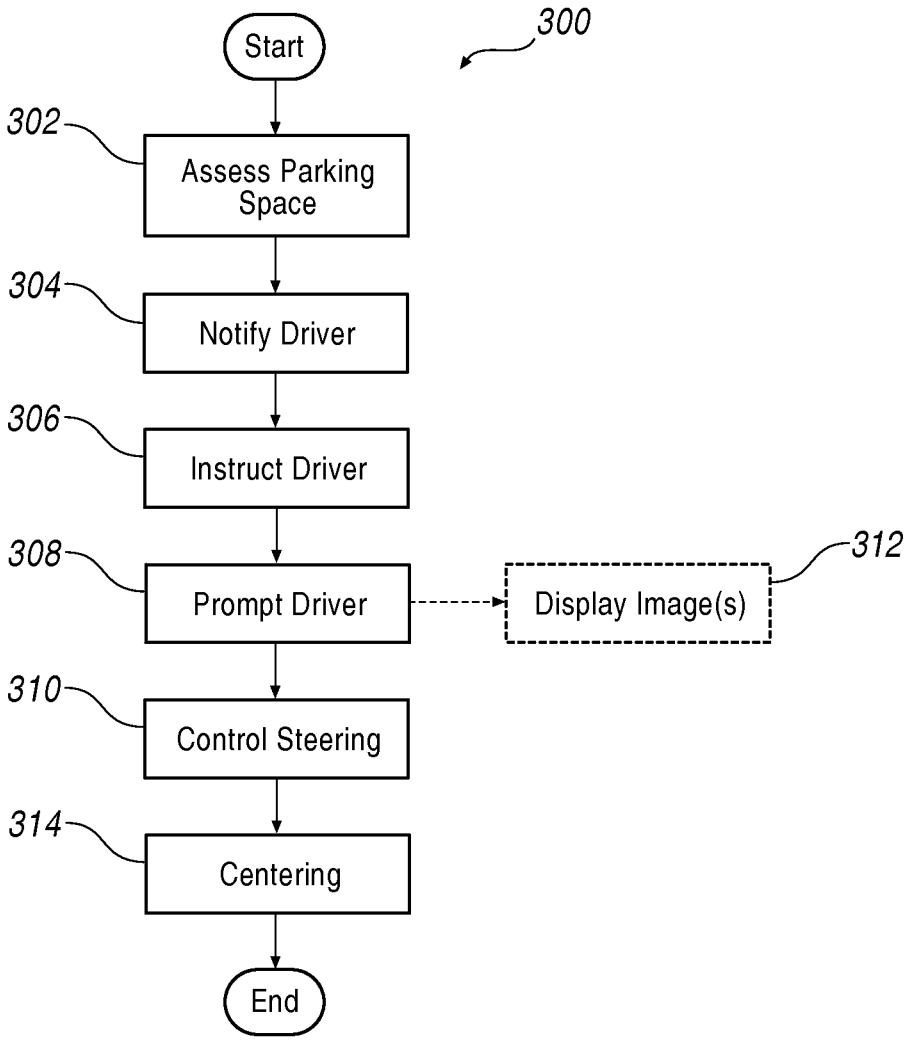
FIG. 3 illustrates a flowchart of a method for parking a vehicle.

Referring to FIG. 3, a flow chart 300 shows a method for parking a vehicle. At first step 302 a processing module, such as PACM 206, determines if there is a feasible parking space available for parking of vehicle 102. This may be accomplished, for example, using signals from sensor(s) 114 of sensing system 228. A feasible parking space is one, such as parking space 106, that is sufficiently large for vehicle 102 to fit into using the park assist system with which it is equipped.

If the parking space is determined at step 302 to be feasible for parking, the driver is notified or alerted at step 304 that a feasible parking space is available. The notification may be delivered via a visual and/or audible signal interface to, for instance, display screen 218 within vehicle 102. Alternatively, the visual interface may be a graphic image, icon, or other non-text representation on display screen 218. Such a visual interface may be located at any appropriate location in vehicle 102, such as an overhead console. Audible signals may be via audio interface 216, as another example.

Next, at step 306 the driver is instructed to stop the vehicle and to accept the system assistance to park. This instruction may be delivered visually and/or audibly, and may be accomplished by the same interface(s) used in step 304. Once the driver has stopped vehicle 102, at step 308 the driver is prompted to remove hands from the steering control device of the steering system (steering wheel 226, for example) and to actuate a brake control device (such as brake pedal 212) and a transmission control device (such as a gear select lever or button) to engage or shift the transmission of powertrain system 214 into reverse gear.

At step 310 the park assist system takes over control of steering system 224 to execute steering trajectory 116. In one example, the park assist system generates signals to prompt the driver to take actions necessary to drive the vehicle backwards and pull forward (in one or more parking maneuvers) to achieve a parked condition of vehicle 102 in parking space 106. The parked condition may be defined, depending upon the nature and dimensions of the parking space, as when vehicle 102 is within a certain distance of one or more of the objects or features that define the space and/or within a certain angular measure of being parallel with the appropriate objects/features.

Driver actions prompted at step 308 may include actions such as actuating brake pedal 212 of braking system 210 to control the speed of the vehicle and/or actuating a transmission control device to engage or shift the transmission of the powertrain system 214 between forward and reverse gears.

As indicated at step 312, the method may optionally include displaying to the driver an image of the parking space environment. For example, an image 124 from a rear view camera 126 may be displayed on a video display screen. In another example, a simulated or virtual top view showing the vehicle and its location relative to the parking space may be displayed on display screen 218. Either of these images may be overlaid with lines and/or other symbols depicting the desired steering trajectory 116. In one embodiment, radar systems 128 may be included in the front, and/or rear, and/or sides of vehicle 102.

When the park assist system has determined that vehicle 102 is properly parked and the final movement of the parking maneuver is complete, the method progresses to step 314 where steering system 220 is operated to place it in a centered condition between surrounding objects such as vehicles 108, 110, or generally in line with curb 112 and/or path 104. This may involve actuating electric motor 224 that provides power boost to the steering system so as to move steering wheel 226 along with associated components of steering system 220 until vehicle 102 wheels are parallel with axis 122 of vehicle 102.

Although the parking space 106 has been described as a parallel parking space between a forward first object and a rearward second object, the parking space may alternatively be a rear perpendicular parking space, such as found in typical multi-vehicle parking lots and garages. Additionally, parking space 106 has been described as being on the right side of the vehicle 102, but alternatively the park assist system may be used to identify a parking space on the left side of vehicle 102.

Figure 4:
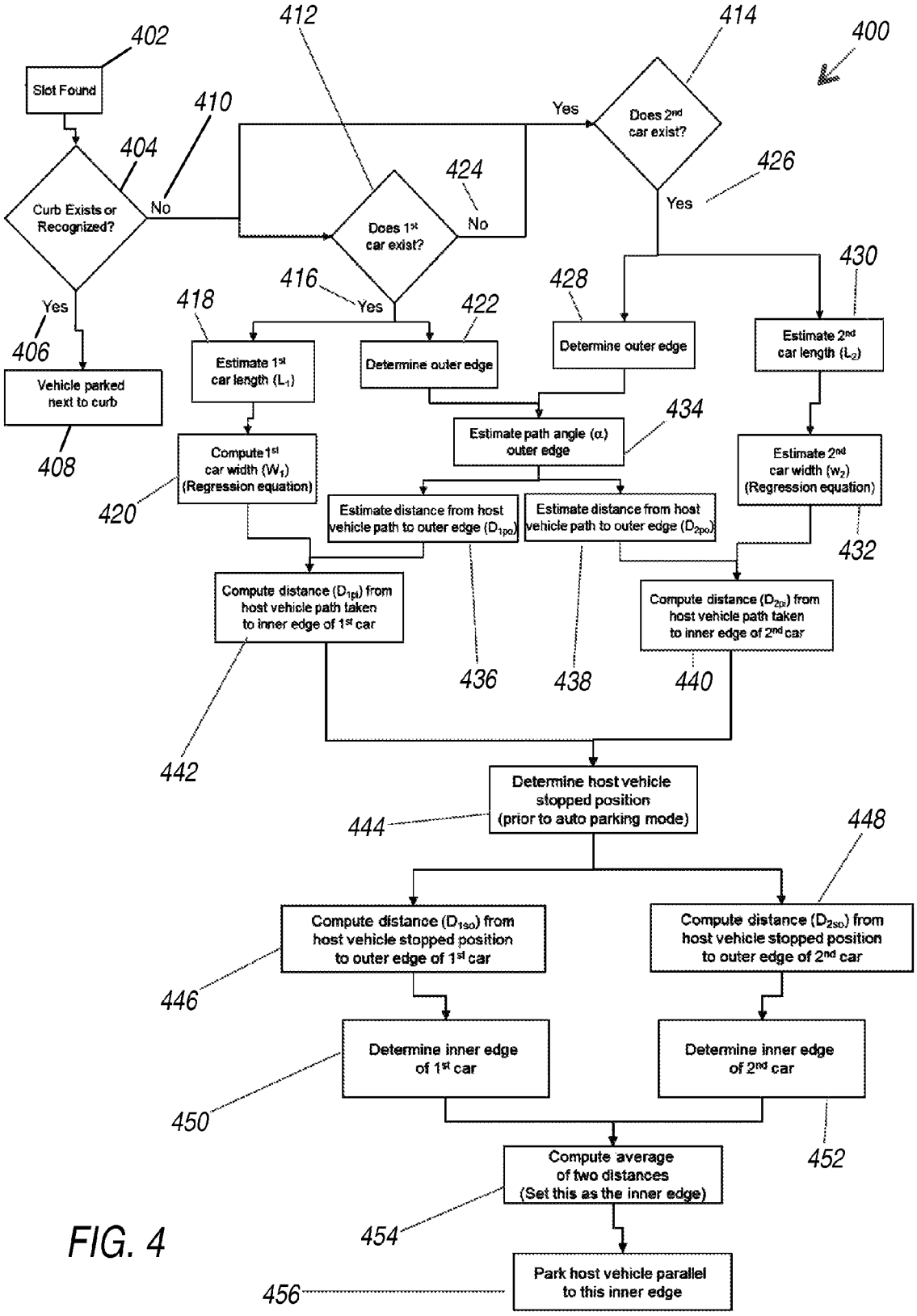
FIG. 4 illustrates an algorithm or method of the logic of an embodiment of the disclosed method.

Referring to FIG. 4, algorithm or method 400 illustrates the logic of an embodiment of the disclosed method. Method 400 begins with identifying a parking slot at step 402 and, at step 404 method 400 determines whether a curb is detectable. If so, 406, then the vehicle is parked 408 using parking assist and using the identified curb as a reference or guide. However, if not 410, then method 400 assesses whether one or two cars are proximate the parking slot. That is, method 400 determines whether a first car exists at step 412, and whether a second car exists at step 414. Steps 412 and 414 assess whether first and second cars exist, or are present, and first and second cars may correspond respectively to parked vehicles 108 and 110 of FIG. 1. Once the presence of one or both cars is determined, each car length is then measured. The length measurement(s) are then used to estimate or calculate a respective width of the car(s) and, based on the outer edge of the car(s), the inner edge(s) of the parked cars are determined and used to define a parking path for parking assist.

Figure 5:
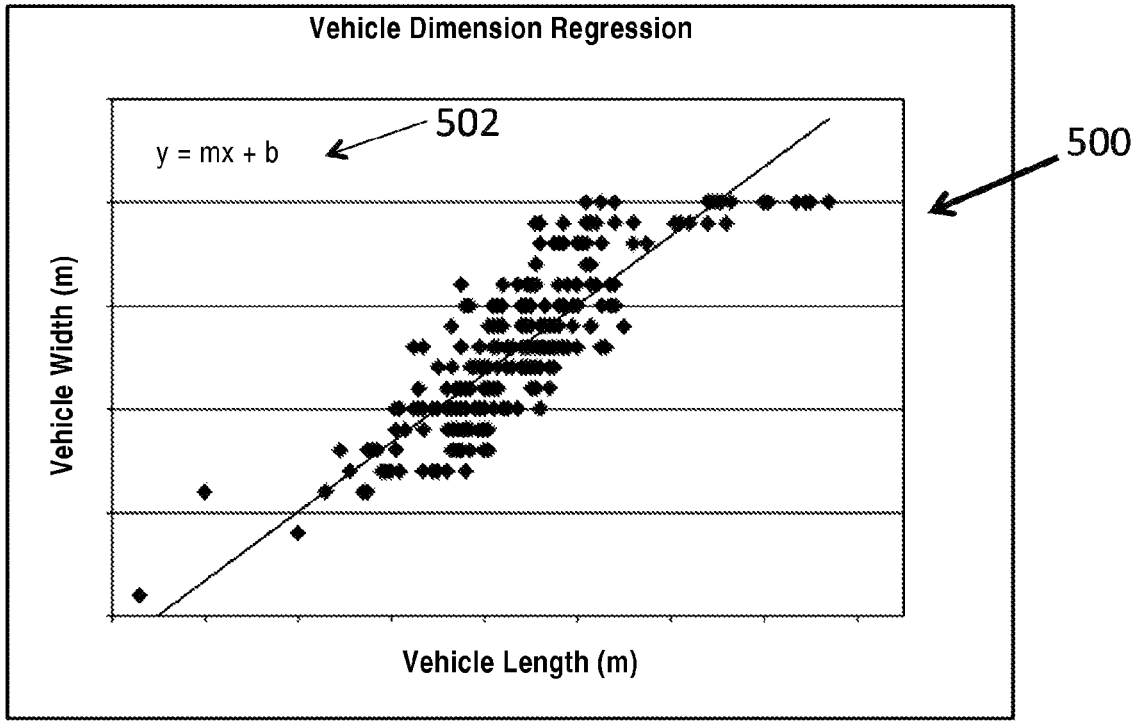
FIG. 5 illustrates exemplary aspect ratio data for known lengths and widths of vehicles.

Referring now to FIG. 5, exemplary aspect ratio data is shown for a population of known lengths and widths of vehicles. The aspect ratio is determined by collecting the aspect ratios of the vehicles that are currently on the road. Using data published by Consumer Reports, over 350 samples 500 were evaluated and a simple regression was carried out for the data to determine an equation 502 that computes the length of the vehicle as a factor of its width.

Equation 502 is used by the Active Park Assist system to align the host vehicle along the inner edges of the surrounding vehicles. Equation 502 is expressed as a linear equation that is linear in the form of y=mx+b, where x corresponds to the first length, y corresponds to the second length, m corresponds to the slope of the regression equation, and b corresponds to the y-intercept of the regression equation. Further, although equation 502 is a linear equation, it is contemplated that any form of regression or curvefit may be executed and that equation 502 may instead by a polynomial fit, a power equation fit, and the like.

Referring back to FIG. 4, if a first car is found 416 at step 412, then the length of the first car is estimated or measured 418 using a sensor from vehicle 102, such as one or more of sensors 114 of vehicle 102, and a width of the first car is computed 420 based on the regression equation of FIG. 5. An outer edge of first car is determined at step 422. If first car is not found 424, then method 400 is based on determining a path for parking assist based on only one car that is parked either in front of or behind a slot, such as slot 106. Thus, if second car does exist 426 then its outer edge is determined 428 and its length is estimated or measured 430 using a sensor from vehicle 102, and a width of the second car is computed 432 based on the regression equation of FIG. 5. A path angle $\alpha$ is estimated at step 434, which is the approach angle of vehicle 102 to its position that is assumed prior to engaging parking assist.

Figure 6:
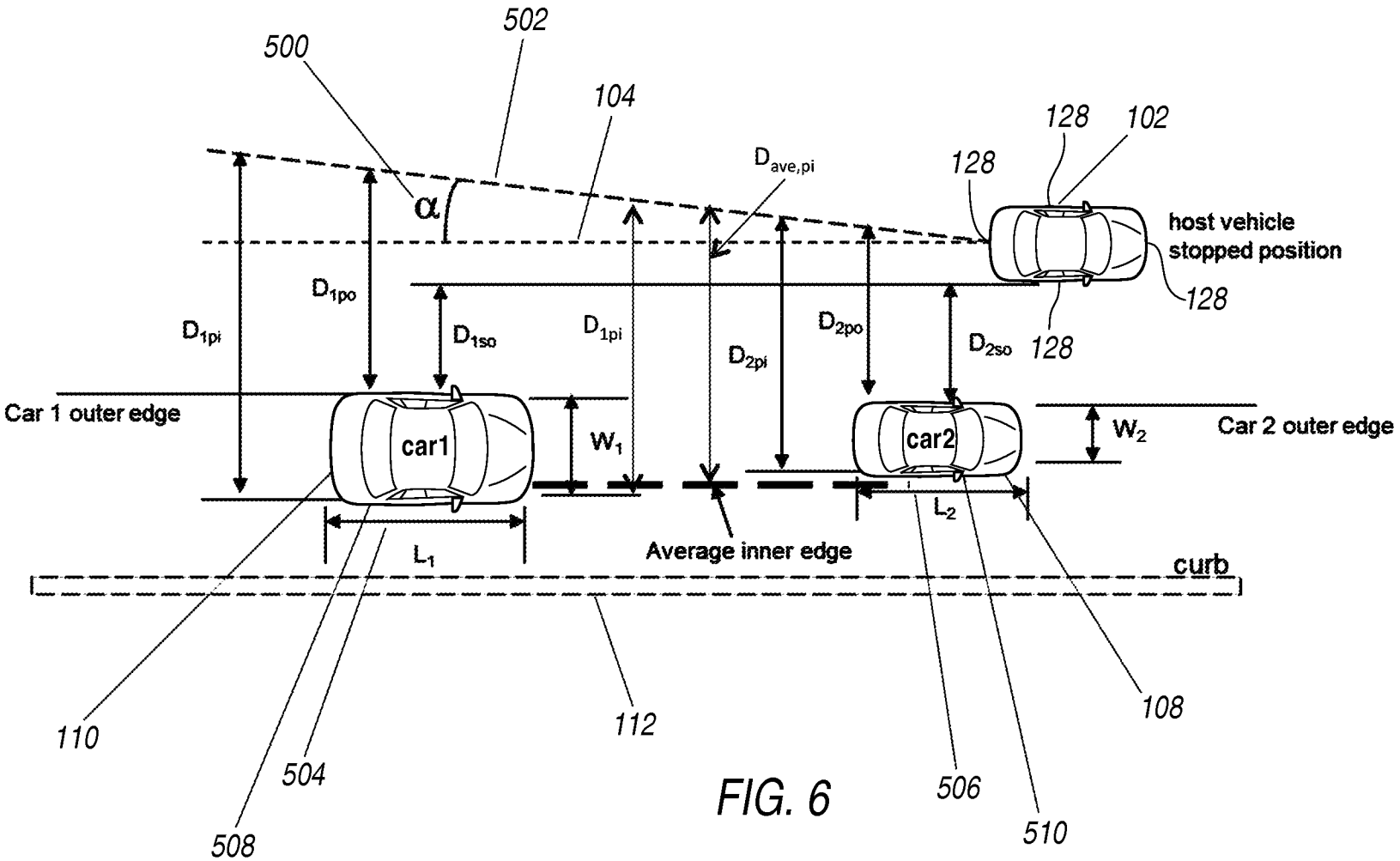
FIG. 6 illustrates a plan view of geometric variables for assessing a parking spot and parking the host vehicle.

Referring to FIG. 6, path angle $\alpha$ (500) is shown as an approach angle that vehicle 102 used in reaching its location prior to engaging parking assist. Path angle $\alpha$ (500) is shown as an angle between path 104 (generally parallel with curb 112), and an approach line 502. Approach path 502, illustrated to be linear, may in fact be a curve or a spline of various curves, which can be determined based on measured distance traveled of the car (using, for instance, wheel speed counts, not shown) and using steering system 220. First length 504 is an axial length of first car 110 and is determined at step 418, and second length 506 is an axial length of second car 108 and is determined at step 430.

Once approach path 502 is determined, and car lengths 504 and 506 are determined, then various other geometric values illustrated in FIG. 6 may likewise be determined to park vehicle 102 using park assist. For instance, distances $D_{1po}$ and $D_{2po}$ may be determined from the measurements taken with sensors 114, which enables the calculation of distances $D_{1so}$ and $D_{2so}$ based on a known geometry of vehicle 102. Widths $W_1$ and/or $W_2$ are calculated or estimated using the regression equation described. As such, an inner edge 508 of first car 110 and/or an inner edge 510 of second car 108 are obtained, which provides distances $D_{2pi}$ and $D_{1pi}$, depending on which (or both) of vehicles 110, 108 is present. If both vehicles 110, 108 are present, then average $D_{ave,pi}$ is calculated.

Consistently, steps in method 400 of FIG. 4 illustrate that described with respect to FIG. 6. That is, at steps 436, 438 distances $D_{1po}$ and $D_{2po}$ are determined, and distances $D_{2pi}$ and $D_{1pi}$ are determined at respective steps 440, 442. The location of host vehicle 102 is determined 444, and distances $D_{1so}$ and $D_{2so}$ are determined at steps 446, 448. Inner edges of $1^{st}$ and $2^{nd}$ cars are determined at respective steps 450, 452, and the average of the two is calculated at 454. Host vehicle 102 is parked according to the calculation. Further and as stated, if one or the other of vehicles 110, 108 is not present, then the respective steps pertaining to the vehicle that is not present are not performed, and the average value computed at step 454 is simply equal to the value determined for the distance to the inner car that is present.

Thus, in environments where environmental limitations (i.e. rain, storm, high temperature, etc. . . . ) may prevent detection of a curb, or where curb profiles may not be detectable using an ultrasonic or other sensor, the disclosed method thus enables a driver to park a vehicle without abutting the curb.

PACM 206 may include a computer or a computer readable storage medium implementing method or algorithm 400. In general, computing systems and/or devices, such as the processor and the user input device, may employ any of a number of computer operating systems, including, but by no means limited to, versions and/or varieties of the Microsoft Windows® operating system, the Unix operating system (e.g., the Solaris® operating system distributed by Oracle Corporation of Redwood Shores, Calif.), the AIX UNIX operating system distributed by International Business Machines of Armonk, N.Y., the Linux operating system, the Mac OS X and iOS operating systems distributed by Apple Inc. of Cupertino, Calif., and the Android operating system developed by the Open Handset Alliance.

Computing devices generally include computer-executable instructions, where the instructions may be executable by one or more computing devices such as those listed above. Computer-executable instructions may be compiled or interpreted from computer programs created using a variety of programming languages and/or technologies, including, without limitation, and either alone or in combination, Java™, C, C++, Visual Basic, Java Script, Perl, etc. In general, a processor (e.g., a microprocessor) receives instructions, e.g., from a memory, a computer-readable medium, etc., and executes these instructions, thereby performing one or more processes, including one or more of the processes described herein. Such instructions and other data may be stored and transmitted using a variety of computer-readable media.

A computer-readable medium (also referred to as a processor-readable medium) includes any non-transitory (e.g., tangible) medium that participates in providing data (e.g., instructions) that may be read by a computer (e.g., by a processor of a computer). Such a medium may take many forms, including, but not limited to, non-volatile media and volatile media. Non-volatile media may include, for example, optical or magnetic disks and other persistent memory. Volatile media may include, for example, dynamic random access memory (DRAM), which typically constitutes a main memory. Such instructions may be transmitted by one or more transmission media, including coaxial cables, copper wire and fiber optics, including the wires that comprise a system bus coupled to a processor of a computer. Common forms of computer-readable media include, for example, a floppy disk, a flexible disk, hard disk, magnetic tape, any other magnetic medium, a CD-ROM, DVD, any other optical medium, punch cards, paper tape, any other physical medium with patterns of holes, a RAM, a PROM, an EPROM, a FLASH-EEPROM, any other memory chip or cartridge, or any other medium from which a computer can read.

Databases, data repositories or other data stores described herein may include various kinds of mechanisms for storing, accessing, and retrieving various kinds of data, including a hierarchical database, a set of files in a file system, an application database in a proprietary format, a relational database management system (RDBMS), etc. Each such data store is generally included within a computing device employing a computer operating system such as one of those mentioned above, and are accessed via a network in any one or more of a variety of manners. A file system may be accessible from a computer operating system, and may include files stored in various formats. An RDBMS generally employs the Structured Query Language (SQL) in addition to a language for creating, storing, editing, and executing stored procedures, such as the PL/SQL language mentioned above.

In some examples, system elements may be implemented as computer-readable instructions (e.g., software) on one or more computing devices (e.g., servers, personal computers, etc.), stored on computer readable media associated therewith (e.g., disks, memories, etc.). A computer program product may comprise such instructions stored on computer readable media for carrying out the functions described herein.

With regard to the processes, systems, methods, heuristics, etc. described herein, it should be understood that, although the steps of such processes, etc. have been described as occurring according to a certain ordered sequence, such processes could be practiced with the described steps performed in an order other than the order described herein. It further should be understood that certain steps could be performed simultaneously, that other steps could be added, or that certain steps described herein could be omitted. In other words, the descriptions of processes herein are provided for the purpose of illustrating certain embodiments, and should in no way be construed so as to limit the claims.

Accordingly, it is to be understood that the above description is intended to be illustrative and not restrictive. Many embodiments and applications other than the examples provided would be apparent upon reading the above description. The scope should be determined, not with reference to the above description, but should instead be determined with reference to the appended claims, along with the full scope of equivalents to which such claims are entitled. It is anticipated and intended that future developments will occur in the technologies discussed herein, and that the disclosed systems and methods will be incorporated into such future embodiments. In sum, it should be understood that the application is capable of modification and variation.

All terms used in the claims are intended to be given their broadest reasonable constructions and their ordinary meanings as understood by those knowledgeable in the technologies described herein unless an explicit indication to the contrary in made herein. In particular, use of the singular articles such as "a," "the," "said," etc. should be read to recite one or more of the indicated elements unless a claim recites an explicit limitation to the contrary.

The invention claimed is:

1. A method of parking a running vehicle comprising:

measuring a first length of a parked vehicle that is proximate to a desired parking location;

estimating a second length of the parked vehicle based on the measured first length; and parking the running vehicle based on the estimated second length.

2. The method of claim 1, wherein measuring the first length comprises measuring the first length of the parked vehicle using at least one ultrasonic sensor positioned on the running vehicle.

3. The method of claim 1, further comprising estimating the second length of the parked vehicle based on a population of vehicles having known lengths and widths.

4. The method of claim 3, wherein the known lengths and widths of the population of vehicles is expressed as a regression equation that is derived from the known lengths and widths.

5. The method of claim 4, wherein the regression equation is linear in the form of y=mx+b, where x corresponds to the first length, y corresponds to the second length, m corresponds to the slope of the regression equation, and b corresponds to the y-intercept of the regression equation.

6. The method of claim 1, wherein:

the first length is an axial length of the parked vehicle; and the second length is a width of the parked vehicle;

the method further comprising:

determining an outer edge location of the parked vehicle;

determining an inner edge location of the parked vehicle based on its estimated width; and parking the running vehicle based on the inner edge location.

7. The method of claim 1, further comprising:

determining a location of a parking space proximate the parked vehicle, wherein the parked vehicle is in front of or behind the parking space;

determining a trajectory for the running vehicle to park the running vehicle in the parking space; and instructing a driver of the running vehicle which actions to take to park the running vehicle in the parking location.

8. The method of claim 7, further comprising:

measuring a third length of a second parked vehicle that is parked behind or in front of the parking space;

estimating a fourth length of the second parked vehicle based on the measured third length; and parking the running vehicle based on an average of the estimated fourth length and the second length.

9. A non-transitory computer-readable medium tangibly embodying computer-executable instructions comprising steps to:

measure a first length of a parked vehicle that is adjacent to a desired parking location;

determine a second length of the parked vehicle based on the measurement; and execute a vehicle parking algorithm based on the second length estimation.

10. The non-transitory computer-readable medium of claim 9, further comprising steps to measure the first length of the parked vehicle using an ultrasonic sensor.

11. The non-transitory computer-readable medium of claim 9, further comprising steps to determine the second length of the parked vehicle based on a regression equation that is derived from known lengths and widths of a population of vehicles.

12. The non-transitory computer-readable medium of claim 9, wherein the regression equation is linear in the form of y=mx+b, where x corresponds to the first length, y corresponds to the second length, m corresponds to the slope of the regression equation, and b corresponds to the y-intercept of the regression equation.

13. The non-transitory computer-readable medium of claim 9, further comprising steps to:

determine an inner edge of the parked vehicle based on a known location of an outer edge of the parked vehicle and based on the second length of the parked vehicle; and execute the parking algorithm based on the determination.

14. The non-transitory computer-readable medium of claim 9, wherein the algorithm includes instructions of which actions to take to park a running vehicle in the desired parking location for a driver to execute.

15. A host vehicle comprising:

a system for measuring a first length of a parked vehicle; and a computer programmed to:

estimate a second length of the parked vehicle based on the first length; and instruct a controller to park the host vehicle based on the estimated length.

16. The host vehicle of claim 15, wherein the system comprises at least one ultrasonic sensor.

17. The host vehicle of claim 15, wherein the computer is further programmed to estimate the second length of the parked vehicle based on a population of vehicles having known lengths and widths, wherein the known lengths and widths of the population of vehicles is expressed as a regression equation that is derived from the known lengths and widths.

18. The host vehicle of claim 17, wherein the regression equation is linear in the form of $y=mx+b$, where x corresponds to the first length, y corresponds to the second length, m corresponds to the slope of the regression equation, and b corresponds to the y-intercept of the regression equation.

19. The host vehicle of claim 15, wherein:

the first length is an axial length of the parked vehicle; and the second length is a width of the parked vehicle;

wherein the computer is further programmed to:

determine an outer edge location of the parked vehicle;

determine an inner edge location of the parked vehicle based on its estimated width; and park the host vehicle based on the inner edge location.

20. The host vehicle of claim 15, wherein the computer is further programmed to:

determine a location of a parking space proximate the parked vehicle, wherein the parked vehicle is in front of or behind the parking space;

determine a trajectory for the host vehicle to park the host vehicle in the parking space; and instruct a driver of the host vehicle which actions to take to park the host vehicle in the parking location.

* * * * *